US007331919B2

(12) United States Patent
Niemerg

(10) Patent No.: US 7,331,919 B2
(45) Date of Patent: Feb. 19, 2008

(54) CENTRIFUGAL DRUM FOR A SEPARATOR

(75) Inventor: Willi Niemerg, Oelde (DE)

(73) Assignee: Westfalia Separator AG, Oelde (DE)

( * ) Notice: Subject to any disclaimer, the term of this patent is extended or adjusted under 35 U.S.C. 154(b) by 263 days.

(21) Appl. No.: 10/798,265

(22) Filed: Mar. 12, 2004

(65) Prior Publication Data

US 2004/0178127 A1 Sep. 16, 2004

(30) Foreign Application Priority Data

Mar. 12, 2003 (DE) ..... 103 11 168

(51) Int. Cl.
*B04B 3/08* (2006.01)

(52) U.S. Cl. ..... 494/40; 494/41; 494/39

(58) Field of Classification Search ..... 494/64, 494/39, 40, 41, 38; 277/358, 587
See application file for complete search history.

(56) References Cited

U.S. PATENT DOCUMENTS 2,828,069 A * 3/1958 Steinacker et al. ..... 494/40
3,085,743 A * 4/1963 Hemfort et al. ..... 494/27
3,837,567 A * 9/1974 Nilson et al. ..... 494/7
3,902,661 A * 9/1975 Meis et al. ..... 494/38
4,235,367 A * 11/1980 Davidson ..... 494/38
4,284,233 A * 8/1981 Kulker ..... 494/27
4,342,419 A * 8/1982 Conway ..... 494/10
4,534,570 A * 8/1985 Munde ..... 277/399
4,710,160 A * 12/1987 Klintenstedt et al. ..... 494/64
6,286,838 B1 * 9/2001 Kruger et al. ..... 277/549

FOREIGN PATENT DOCUMENTS

| | | |
|---|---|---|
| CH | 325207 | 12/1957 |
| DE | 818023 | 7/1949 |
| DE | 2328346 | 6/1973 |
| DE | 287 147 A7 | 10/1983 |
| DE | 196 09 353 C1 | 9/1997 |
| GB | 765034 | 3/1955 |
| WO | WO 00/53327 | 9/2000 |

* cited by examiner

*Primary Examiner*—Kaitlin S. Joerger
(74) *Attorney, Agent, or Firm*—Barnes & Thornburg LLP

(57) ABSTRACT

A centrifugal drum for a separator having a vertical axis of rotation, including a drum bottom part and a drum cover fastened to the drum bottom part by a locking ring. Also included is a centering ring arranged between the drum bottom part and the drum cover such that while the centering ring is being pretensioned, it sealingly and centeringly braces the drum bottom part and the drum cover relative to one another.

13 Claims, 1 Drawing Sheet

Fig. 1
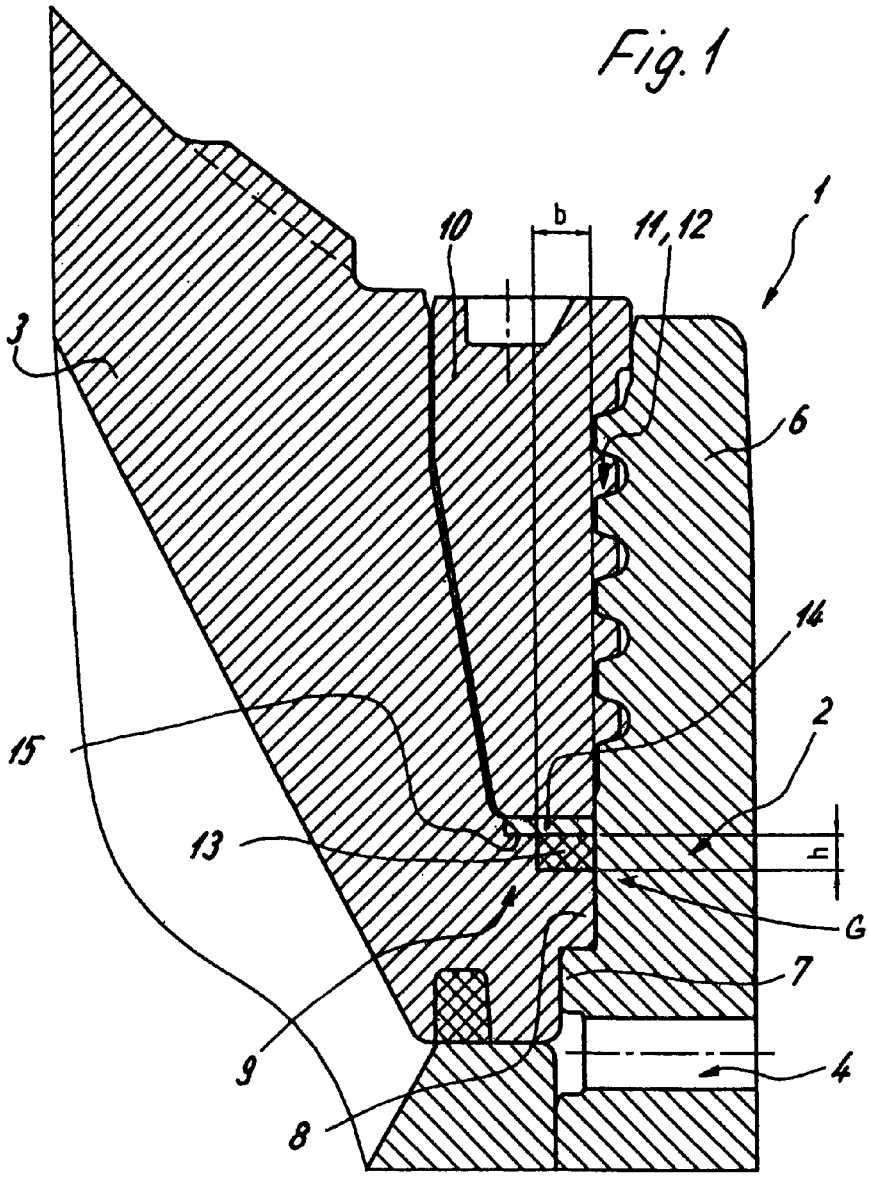
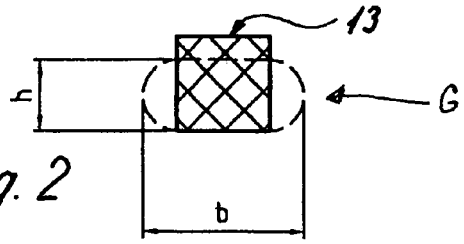
Fig. 2

CENTRIFUGAL DRUM FOR A SEPARATOR

CROSS-REFERENCE

This non-provisional application claims benefit of and priority to German Application Number 103 11 168.9-23, filed Mar. 12, 2003, the disclosure of which is hereby incorporated by reference herein.

BACKGROUND

The present disclosure relates to a centrifugal drum for a separator, which may have a vertical axis of rotation, a drum bottom part and a drum cover which is fastened to the drum bottom part by a locking ring.

A centrifugal drum of the above-mentioned type is known from German Patent Document DD 287 147. A centering cone is constructed between the drum bottom part and the drum cover, which centering cone has the purpose of compensating the extensions of elements during the rotation of the drum. It is also known from this document to arrange sealing rings between the drum bottom part and the drum cover. Also see, for example, British Patent Document GB 765,034.

International Patent Document WO 00/53327 replaces known locking rings having a screw thread by a band-type locking ring which is arranged in a sloped manner with respect to the axis of rotation or non-concentrically between the drum bottom part and the drum cover.

Concerning the state of the art, also see German Patent Documents DE 2 328 346 A, and DE 818 023 C, Swiss Patent Document CH 325207 and German Patent Document DE 196 09 353 C1.

SUMMARY

The present disclosure further develops a centrifugal drum of the above-mentioned type such that the drum cover can be centered at the drum bottom part by devices.

The present disclosure relates to a centrifugal drum for a separator having a vertical axis of rotation. The centrifugal drum includes a drum bottom part and a drum cover fastened to the drum bottom part by a locking ring. A centering ring is arranged between the drum bottom part and the drum cover such that, while the centering ring is being pretensioned, it sealingly and centeringly braces the drum bottom part and the drum cover relative to one another.

As a result of the use of the centering ring and its arrangement, a centering cone or a high-expenditure clamping between the drum cover and the drum bottom part, for the purpose of a centering, can be eliminated and replaced by a the above-mentioned centering ring, which may be made of an elastic material, such as rubber.

Simultaneously, a reliable sealing-off of the centrifugal drum is implemented in an area between the drum bottom part and the drum cover. This also reduces the risk of corrosion, particularly in an area of a thread between a locking ring and the centrifugal drum. Since no additional constructive measures are required for the centering on the drum bottom part, a tension level in the drum bottom part is lowered by the larger wall thickness which can be implemented.

According to an embodiment of the present disclosure, the drum cover engages in the drum bottom part, and the centering ring is arranged between an outer circumference of the drum cover and an inner circumference of the drum bottom part. The centering ring is designed such that a centering and sealing effect is maintained in an operation of the separator up to the maximal rotational speed. As an alternative, embodiments are also conceivable in which the drum bottom part engages from below in the drum cover.

While being axially pretensioned or deformed, the centering ring is arranged, possibly in an elastic manner, between the outer circumference of the drum cover and the inner circumference of the drum bottom part in order to permit the centering and sealing effect in a simple manner.

An inner collar is shaped to an inner circumference of an upper ring section of the drum bottom part, on which collar a correspondingly complementarily shaped collar rests which is situated on an outer circumference of a lower ring section of the drum cover. In addition, when the axis of rotation is vertical, a pressure element, such as a ring disk, acts upon the centering ring from above or below, which presses the centering ring onto the collar at the drum cover or at the drum bottom part. In this manner, the locking ring can exercise an axial compression force upon the centering ring made of an elastic material.

Other aspects of the present disclosure will become apparent from the following descriptions when considered in conjunction with the accompanying drawings.

BRIEF DESCRIPTION OF THE DRAWINGS

FIG. 1 is a sectional view of a contact area between a bottom part and a drum cover of a centrifugal drum of a separator, according to the principles of the present disclosure.

FIG. 2 is a sectional view of a centering ring, shown before and after installation.

DETAILED DESCRIPTION OF THE DRAWINGS

The following description relates to separators with a vertical axis of rotation. Terms such as "above" or "below" relate to this type of installation situation or separator configuration, but should not be understood to be limiting.

Centrifugal drum 1 of a separator, as shown in FIG. 1, has a vertical axis of rotation. The drum 1 has a bottom part 2, and in an upper circumferential area, drum 1 has a drum cover 3 or a drum top part that engages the drum bottom part 2.

In an upper circumferential area, illustrated in FIG. 1, the drum bottom part 2 includes a ring shape or cylindrical shape or upper ring section 6 which lies above solids discharge openings 4. The remaining shaping of the drum bottom part 2 in a downward direction, as seen in FIG. 1, may, for example, have a conical or cylindrical ("can-type") construction.

An inner collar 7 is molded to an inner circumference of the upper ring section 6 of the drum bottom part 2. A correspondingly complementarily shaped collar 8 on an outer circumference of a lower ring section 9 of the drum cover 3, which otherwise is conical at least in sections in an upward direction, rests on this collar 7.

A locking of the drum cover 3 on the drum bottom part 2 takes place by a locking ring 10 which has an external thread 11, by which it is screwed from above into an internal thread 12 of the drum bottom part 2. Among other things, the locking ring 10 has the purpose of fixing the drum cover 3 in the axial direction.

Above the outer collar 8, at the drum cover 3, a centering ring 13 is arranged at an outer circumference of the drum cover 3.

The centering ring 13, which is stressed, includes an elastically deformable material, such as rubber. It is deformed or pretensioned by axial force or pressure. This takes place in that the locking ring 6 presses from above by way of a pressure element or ring disk 14 onto the centering ring 13. The centering ring 13, while being compressed; in an elastic and quasi "pretensioned" manner between the drum bottom part 2 and the drum cover 3 off a gap G of width b, between the drum bottom part 2 and drum cover 3. The centering ring 13 also braces the drum cover 3 and the drum bottom part 2 with respect to one another in a radial direction, seals them off relative to one another and centers them relative to one another.

The centering ring 13 is dimensioned and is acted upon by pressure force such that the sealing and centering is maintained also in an operation up to the highest rotational speeds of the separator, thus the drum bottom part 2 and the drum cover 3 are still centered relative to one another and sealed off also in this operating condition despite their possible different expansion behavior.

The ring disk 14 is dimensioned such that, on the one hand, it almost completely covers the gap G in an upward direction and, on the other hand, rests on a collar-type step 15 of the drum bottom part 2 in an inward direction.

By dimensioning the width b and a height h of the space or the gap G for the centering ring 13 and by dimensioning and selecting the material of the centering ring 13, a radial spring effect of the centering ring 13 is adjusted such that a desired effect is achieved or that the centering and sealing is maintained to the maximal rotational speed of the separator. As an example, FIG. 2 illustrates the deformation of the centering ring 13 during an installation. A solid line around centering ring 13 represents pre-installation and a dotted line represents post-installation during an operation, which may be at a maximal rotational speed and with an expansion of the drum bottom part 2. The centering ring 13 is therefore deformed to level h. For this reason and because of its pretensioning and its spring effect, when the drum bottom part 2 expands, the centering ring 13 can expand and widen beyond the width b, so that it carries out its sealing and centering function over the entire rotational speed range of the separator.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A centrifugal drum for a separator having a vertical axis of rotation, comprising:

a drum bottom part and a drum cover fastened to the drum bottom part by a locking ring, a centering ring arranged radially between the drum bottom part and the drum cover and axially between the drum cover and the locking ring such that while the centering ring is being pretensioned by movement of the locking ring relative to the drum cover, the sealing ring sealingly and centeringly braces the drum bottom part and the drum cover relative to one another; and a ring disk which acts upon the centering ring and presses the centering ring upon a collar of at least one of at the drum cover and at the drum bottom part.

2. The centrifugal drum according to claim 1, wherein the drum cover engages in the drum bottom part, and the centering ring is arranged between an outer circumference of the drum cover and an inner circumference of the drum bottom part, the centering ring being configured such that the centering and sealing is maintained during an operation to a maximal rotational speed of the separator.

3. The centrifugal drum according to claim 1, wherein the centering ring, is axially pretensioned and arranged between an outer circumference of the drum cover and an inner circumference of the drum bottom part.

4. The centrifugal drum according to claim 1, wherein the centering ring includes elastically deformable material and is arranged between an outer circumference of the drum cover and an inner circumference of the drum bottom part.

5. The centrifugal drum according to claim 1, wherein an inner collar on an inner circumference of an upper ring section of the drum bottom part, on which inner collar a correspondingly complementarily shaped outer collar rests and which complementarily shaped outer collar is situated on an outer circumference of a lower ring section of the drum cover.

6. The centrifugal drum according to claim 1, wherein the centering ring is arranged above an outer collar of the drum cover.

7. The centrifugal drum according to claim 1, wherein the ring disk is dimensioned such that it covers a gap between an inner circumference of the drum bottom part and an outer circumference of the drum cover in an area above a collar, and rests on a step of the drum bottom part in an inward direction.

8. The centrifugal drum according to claim 1, wherein, by dimensioning a width and a height of a gap for the centering ring between the drum bottom part and the drum cover, and by dimensioning and selecting a material of the centering ring, a radial spring effect of the centering ring is adjusted such that the centering and sealing in an operation of the drum is maintained to a maximal rotational speed of the separator.

9. The centrifugal drum of claim 4, wherein the elastically deformable material includes rubber.

10. The centrifugal drum of claim 1, wherein the ring disk acts upon the centering ring from above the centering ring.

11. A centrifugal drum for a separator having a vertical axis of rotation, comprising:

a drum bottom part and a drum cover fastened to the drum bottom part by a locking ring;

a centering ring arranged radially between the drum bottom part and the drum cover and axially between the drum cover and the locking ring such that while the centering ring is being pretensioned by movement of the locking ring relative to the drum cover, it sealingly and centeringly braces the drum bottom part and the drum cover relative to one another;

a ring disk which acts upon the centering ring and presses the centering ring upon a collar of at least one of at the drum cover and at the drum bottom part; and wherein the drum cover engages in the drum bottom part and the centering ring is arranged directly between an outer circumference of the drum cover and an inner circumference of the drum bottom part, the centering ring being configured such that the centering and sealing is maintained during an operation to a maximal rotational speed of the separator.

12. A centrifugal drum for a separator having a vertical axis of rotation, comprising:

a drum bottom part and a drum cover fastened to the drum bottom part by a locking ring;

a centering ring arranged radially between the drum bottom part and the drum cover and axially between the drum cover and the locking ring such while the centering ring is being pretensioned by movement of the locking ring relative to the drum cover, it sealingly and centeringly braces the drum bottom part and the drum cover relative to one another, and wherein in an installed position, a ring disk is located above and acts upon the centering ring and presses the centering ring upon a collar portion of the drum cover.

13. The centrifugal drum of claim 12, wherein the collar portion is located on an outer circumference of the drum cover.

* * * * *